US008577746B1

(12) United States Patent
Milgrom et al.

(10) Patent No.: US 8,577,746 B1
(45) Date of Patent: Nov. 5, 2013

(54) SYSTEM AND METHOD FOR MULTI-PRODUCT CLOCK AUCTIONS

(75) Inventors: Paul R. Milgrom, Stanford, CA (US); David J. Salant, Tiburon, CA (US)

(73) Assignee: Auction Technologies, LLC, Tiburon, CA (US)

( * ) Notice: Subject to any disclaimer, the term of this patent is extended or adjusted under 35 U.S.C. 154(b) by 414 days.

(21) Appl. No.: 12/889,256

(22) Filed: Sep. 23, 2010

Related U.S. Application Data

(60) Provisional application No. 61/245,017, filed on Sep. 23, 2009.

(51) Int. Cl.
*G06Q 30/00* (2012.01)

(52) U.S. Cl.
USPC ..... 705/26.3; 705/37; 705/27.1

(58) Field of Classification Search
USPC ..... 705/26.1–27.2, 37
See application file for complete search history.

(56) References Cited

U.S. PATENT DOCUMENTS

2007/0192233 A1 * 8/2007 Salant et al. ..... 705/37

OTHER PUBLICATIONS

JR west faces oversubscription of shares in fixed-price offering. (Aug. 22, 1966). Asian Wall Street Journal, pp. 16-16.*

* cited by examiner

*Primary Examiner* — Jeffrey A Smith
*Assistant Examiner* — Resha Desai
(74) *Attorney, Agent, or Firm* — Patent Law Works LLP

(57) ABSTRACT

A system and method for adjusting prices and/or quantities of products in a multi-product clock auction are disclosed. An auction manager module determines first prices for the products and subsequently receives first bids from one or more bidding devices based on the first prices. After receiving first bids using the first prices, the auction manager module modifies the first prices to generate adjusted prices if the first bids indicate a product is oversubscribed. After receiving second bids using the adjusted prices, if a product is undersubscribed, the auction manager module rolls back the adjusted price of the undersubscribed product to the first price. In one embodiment, the auction manager module also rolls back product quantities from the second bids to quantities from the first bids if such a modification alleviates product undersubscription.

17 Claims, 8 Drawing Sheets

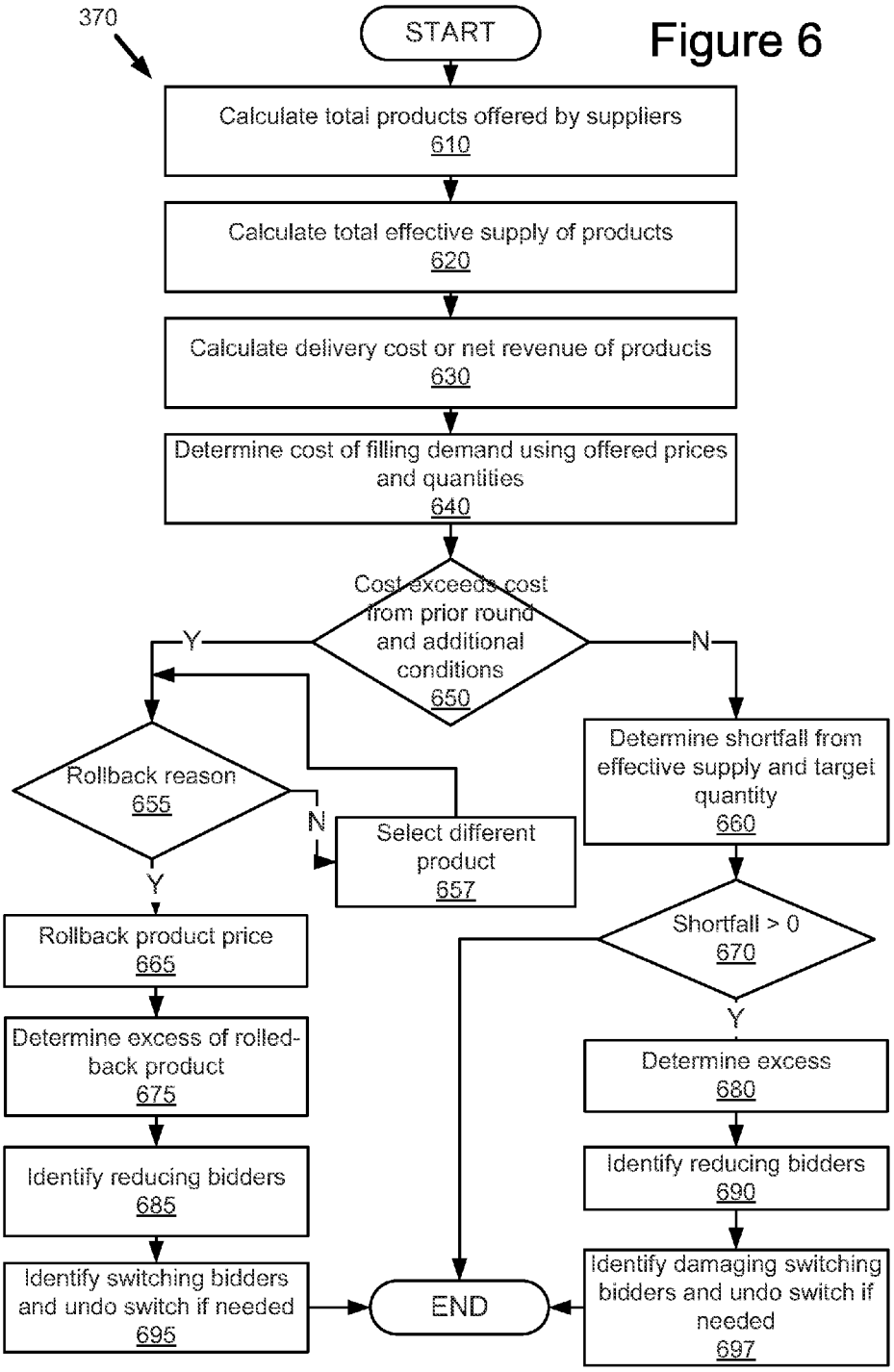
370
START
Figure 6
Calculate total products offered by suppliers
610
Calculate total effective supply of products
620
Calculate delivery cost or net revenue of products
630
Determine cost of filling demand using offered prices and quantities
640
Cost exceeds cost from prior round and additional conditions
650
Y
N
Rollback reason
655
N
Select different product
657
Y
Rollback product price
665
Determine excess of rolled-back product
675
Identify reducing bidders
685
Identify switching bidders and undo switch if needed
695
Determine shortfall from effective supply and target quantity
660
Shortfall > 0
670
Y
Determine excess
680
Identify reducing bidders
690
Identify damaging switching bidders and undo switch if needed
697
END

SYSTEM AND METHOD FOR MULTI-PRODUCT CLOCK AUCTIONS

CROSS-REFERENCE TO RELATED APPLICATIONS

This application claims priority, under 35 U.S.C. §119(e), to U.S. Provisional Patent Application No. 61/245,017, filed on Sep. 23, 2009, which is incorporated by reference herein in its entirety.

BACKGROUND OF THE INVENTION

1. Field of the Invention

The present invention generally relates to multi-product clock auctions and more specifically to optimizing price adjustments and rollbacks at each round of a multi-product clock auction.

2. Description of the Background Art

In a multi-product clock auction, bidders place bids on products during different rounds. A different number of eligibility points per unit are assigned to different products being auctioned. Bidders participating in the multi-product clock auction are also assigned eligibility points specifying the total amount of products on which a bidder may bid. For example, if a first product is assigned two eligibility points per unit, a second product is assigned one eligibility point per unit and a bidder is assigned an initial total eligibility of ten points, the bidder can initially enter a bid for up to five units of the first product, for up to ten units of the second product or for a combination of the first product and the second product whose total points do not exceed ten. A bidder's "activity" during a round of the auction is the total number of points associated with a bid during the round, and generally the bidder's eligibility is the upper bound of the bidder's activity.

During rounds of the multi-product clock auction, an auction manager receives bids from one or more bidders. Prior to the start of the first round, an auction manager announces, or otherwise notifies participating bidders, of an initial price for the products being auctioned. During the first round, each participating bidder places a bid, and bids placed after the end of the first round and before the start of a subsequent round are not entered. In a clock auction where the auctioneer seeks to buy a product, a bid is an offer to supply quantities of the offered products at the announced prices for the round. In a clock auction where the auctioneer seeks to sell a product, a bid is an offer to purchase quantities of the offered products. A bidder's bid in the first round may be limited so that the bidder's activity does not exceed the bidder's eligibility.

At the close of a round, such as the first round, the auction manager announces the round results and a list of prices to the bidders. The auction manager may also provide additional information about bid quantities, the identities of the bidders or other information. At the close of a round when an auctioneer is buying a product, the auction manager decreases prices of products for which there is excess supply, that is, products for which the sum of the quantities offered exceeds the quantities sought or demanded. Such a product is described as an "oversubscribed" product. At the close of a round when an auctioneer is selling a product, the auction manager increases prices of products for which there is excess demand, that is, for which the sum of the quantities demanded exceeds the quantities offered or supplied to the auction. Such a product is described as an "oversubscribed" product. The auction manager does not adjust the prices of products that are not oversubscribed.

Once a round closes, one or more activity rules are used to determine the eligibility of different bidders for the subsequent round. Often, a bidder's eligibility for the subsequent round is the bidder's total activity from the previously completed round. In some clock auctions, the auction manager may retain offers from an earlier round and count the retained offers as offers from a previously-completed round to prevent products from becoming undersubscribed. In a clock auction where an auctioneer is buying a product, an undersubscribed product is a product for which there is an excess demand, while in a clock auction where an auctioneer is selling a product, an undersubscribed product is a product for which there is an excess supply. Offers retained to prevent undersubscription are counted towards the eligibility of the bidders whose offers were retained for the subsequent round.

After completion of a round and prior to the start of the subsequent round, the auction manager informs bidders of the product prices for the subsequent round and the schedule for the subsequent round. During subsequent round, bidders submit offers in the round that do not exceed their eligibility for the round and bids received after close of the round are not counted. The auction continues as described above as long as at least one product remains oversubscribed. When no product is oversubscribed, the auction manager ends the clock auction and awards products to the bidders making offers in the last round. If the offers made in the last round fail to meet the target volume for a product specified by the auctioneer, the auction manager can award products to offers made in the penultimate round.

In a procurement multi-product clock auction where an auctioneer is purchasing one or more products, prices of products for which there is excess supply generally decrease. In a sale multi-product clock auction where an auctioneer is selling one or more products, prices of products for which there is excess demand generally increase. After any price modification, a product can go from being oversubscribed to being undersubscribed. Without adjustment of price modification, an auction starting with significant oversubscription can end with undersubscription of certain products, i.e., receipt of insufficient bids for certain products. Thus, without adjustment of price modification, an auctioneer may sell much less than buyers may want or an auctioneer may purchase much less than sellers are willing to offer. As an example, in a procurement auction having a starting price of 10 for multiple products and 10 units needed of each product, there may be offers in the first round for 20 units of each product. In the second round, the price of each product may decrease to 9.5 and offers for 5 units of a first product and 35 units of a second product may be received. If the auction manager stops the auction for the first product while continuing the auction for the second product, the first product may end up as undersubscribed despite ample interest. To prevent undersubscription, the auction manager may want to roll back some prices, such as retaining 5 units of first round offers for the first product at a price of 10 while letting the price of the second product decrease to 9 for the subsequent round.

More generally, an auctioneer may not have a pre-determined set of quantities for the auction. For example, if the multi-product clock auction is conducted by an electricity purchaser seeking to meet its power needs, the electricity purchaser may be able to meet its needs by purchasing power from any of several different locations subject to different transmission costs, transmission losses and different transmission constraints applying to electricity from different locations. The electricity purchaser may take bids for power at a first location and at a second location and determine the quantity to take from each location depending on the offered prices, making determination of oversubscription and undersubscription ambiguous while amplifying the need for a procedure to adjust prices between rounds and possibly roll back prices, if necessary.

SUMMARY OF THE INVENTION

Embodiments of the present invention overcome the deficiencies and limitations of the prior art by providing a system and method for adjusting product prices in a multi-product clock auction. In one embodiment of the present invention, in a first round of the multi-product clock auction, first bids for one or more products are received from one or more bidder devices. The first bids are used to determine whether at least one product is oversubscribed. In a multi-product clock auction where an auctioneer is buying products, a product is oversubscribed if the supply of the product exceeds the demand. Similarly, in a multi-product clock auction where an auctioneer is selling products, a product is oversubscribed if the demand for the product exceeds the supply. Responsive to determining at least one product is oversubscribed, a first price associated with one or more products is adjusted to generate one or more adjusted prices.

Second bids are then received from one or more bidder devices using the adjusted prices. The second bids are used to determine whether at least one product is undersubscribed. In a multi-product clock auction where an auctioneer is buying products, a product is undersubscribed if the demand for the product exceeds the supply. Similarly, in a multi-product clock auction where an auctioneer is selling products, a product is oversubscribed if the supply of the product exceeds the demand. Responsive to identifying an undersubscribed product, the adjusted price associated with the undersubscribed product is rolled back to the first price, which is associated with the second bid. The second bids, along with any rolled back prices, are then used to determine whether at least one product is oversubscribed. If no product is oversubscribed, the products are awarded to bidders using the second bids.

In one embodiment, when generating rolled back prices, it is determined whether a reduction in the quantity from a bidding device of an undersubscribed product from the first round to the second round can be offset by disallowing an increase in the quantity from the bidding device of an alternate product from the first round to the second round without leaving the alternate product undersubscribed. If disallowing the increased amount of the alternate product in the second round does not leave the alternate product undersubscribed and offsets undersubscription of the undersubscribed product, the sum of the amounts offered for the undersubscribed product and the alternate product are minimized using the product price and quantities of the undersubscribed product and the alternate product when an auctioneer is buying products. If the auctioneer is selling products, the sum of the values of the offered amounts is maximized using the product prices and quantities of the undersubscribed product and the alternate product.

The features and advantages described herein are not all-inclusive and many additional features and advantages will be apparent to one of ordinary skill in the art in view of the figures and description. Moreover, it should be noted that the language used in the specification has been principally selected for readability and instructional purposes, and not to limit the scope of the inventive subject matter.

BRIEF DESCRIPTION OF THE DRAWINGS

The invention is illustrated by way of example, and not by way of limitation in the figures of the accompanying drawings in which like reference numerals are used to refer to similar elements.

FIG. 6 is a flow chart of one embodiment of a method for rolling back prices of a product in a multi-product clock auction in accordance with the present invention.

DETAILED DESCRIPTION OF THE PREFERRED EMBODIMENTS

Figure 1:
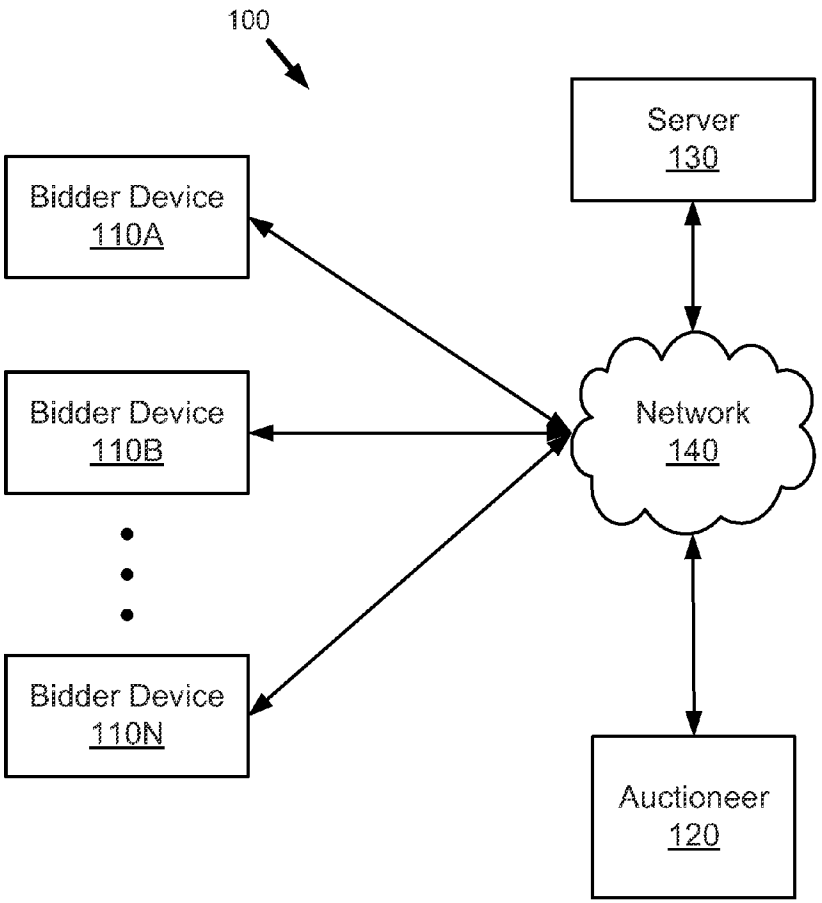
FIG. 1 is a block diagram of one embodiment of a system for implementing a multi-product clock auction in accordance with the present invention.

A system and method for determining prices and rollbacks at various rounds in a multi-product clock auction is described below. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The invention can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device). Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and digital video disk (DVD).

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present invention is described with reference to a particular programming language. It will be appreciated that a variety of programming languages may be used to implement the teachings of the invention as described herein.

System Overview

FIG. 1 shows an embodiment of a system 100 for implementing a multi-product clock auction. The embodiment of the system 100 shown by FIG. 1 comprises one or more bidder devices 110A, 110B, 110N (also referred to individually and collectively as 110), an auctioneer 120, a server 130 and a network 140. In other embodiments, the system 100 may include different and/or additional components than those depicted by FIG. 1.

The one or more bidder devices 110A, 110B, 110N comprise computing devices having data processing and data communication capabilities. For example, a bidder device 110 comprises a desktop computer, a laptop computer, a netbook computer, a tablet computer or a smartphone. In one embodiment, different bidder devices 110A, 110B, 110N comprise different types of computing devices. A bidder device 110 receives data from a bidder and communicates the data to the server 130 via the network 140 using wireless and/or wireless communication techniques. Additionally, a bidder device 110 receives data from the server 130 via the network 140 and presents the data to a bidder using an output device. For example, the bidder device 110 receives a bid from a bidder via an input device such as a keyboard, a touch-screen or a mouse, and uses a network controller to transmit the bid to the server 130 via the network 140. As another example, the bidder device 110 receives product prices and/or a round schedule from the server 130 and presents the product prices and/or round schedule to a bidder using one or more output devices, such as a display device and/or an audio playback device.

The auctioneer 120 exchanges data with the server 130 to purchase one or more products from one or more bidder devices 110 or to sell one or more products to one or more bidder devices 110. In one embodiment, the auctioneer 120 comprises a computing device having data processing and data communication capabilities. Additionally, the auctioneer 120 specifies a target quantity for one or more products during the auction that is communicated to the server 130. In an embodiment, the auctioneer 120 also communicates one or more excess product thresholds and price adjustments to the server 130 to allow more accurate modification of product prices between rounds of the auction.

The server 130 comprises a computing device coupled to the network 140 via one or more wired communication protocols, one or more wireless communication protocols or a combination of wireless and wired communication protocols. The server 130 receives bids from one or more bidder devices 110A, 110B, 110N via the network 140, determines the eligibility of bidders using one or more bidder devices 110A, 110B, 110N for various rounds in a multi-product clock auction and modifies the prices and/or quantities of one or more products at various rounds in the multi-product clock auction. The server 130 is further described below in conjunction with FIG. 2, while the functionality of the server 130 is further described below in conjunction with FIGS. 3-8.

The network 140 is a conventional network and may have any number of configurations such as a star configuration, a token ring configuration or another configuration known to those skilled in the art. In various embodiments, the network 140 comprises a wireless network, a wired network or a combination of a wireless and a wired network. Furthermore, the network 104 may comprise a local area network (LAN), a wide area network (WAN) (e.g., the Internet), and/or any other interconnected data path across which multiple devices may communicate. In yet another embodiment, the network 140 may be a peer-to-peer network. The network 140 may also be coupled to, or include, portions of a telecommunications network for communicating data using a variety of different communication protocols. In yet another embodiment, the network 140 includes Bluetooth communication networks or a cellular communications network for sending and receiving data. For example, the network 140 transmits and/or receives data using one or more communication protocols such short messaging service (SMS), multimedia messaging service (MMS), hypertext transfer protocol (HTTP), direct data connection, WAP, email or another suitable communication protocol.

Figure 2:
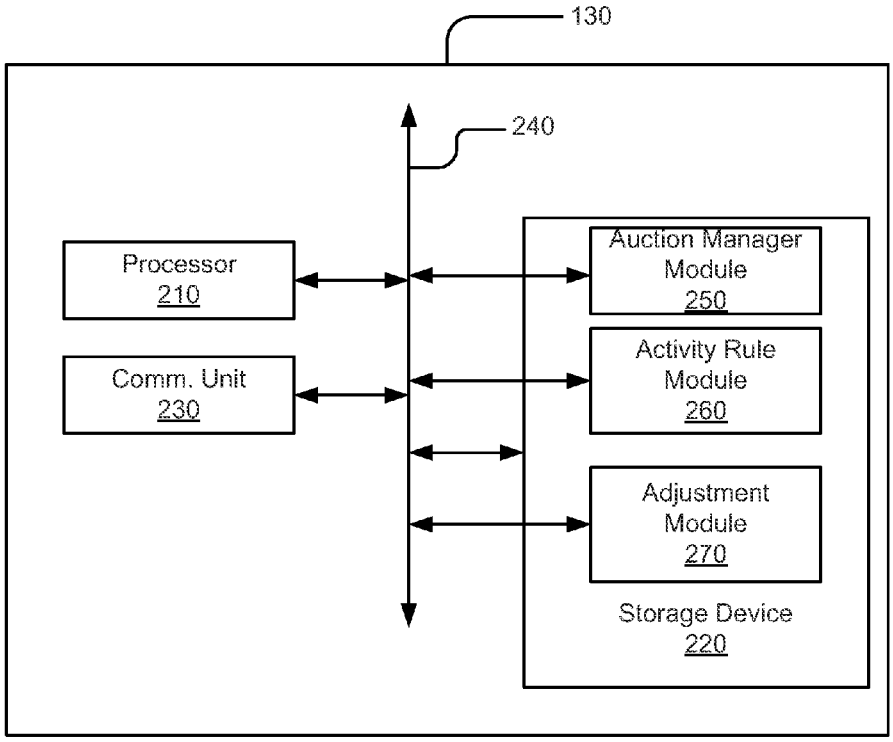
FIG. 2 is a block diagram of one embodiment of a server for determining prices and rollbacks at rounds of a clock auction in accordance with the present invention.

FIG. 2 shows one embodiment of a server 130 for determining prices and rollbacks at rounds of a clock auction is described in further detail. In the embodiment depicted by FIG. 2, the server 130 comprises a processor 210, a storage device 220 and a communication unit 230 coupled to each other via a bus 240; however, in other embodiments the server 130 may include different and/or additional components than the ones shown by FIG. 2.

The processor 210 comprises an arithmetic logic unit, a microprocessor, a general purpose controller or some other processor array to perform computations or other data processing. The processor 210 is coupled to the bus 240 for communication with the other components of the server 130. Processor 210 processes data signals and may comprise various computing architectures including a complex instruction set computer (CISC) architecture, a reduced instruction set computer (RISC) architecture or an architecture implementing a combination of instruction sets. Although only a single processor 210 is shown in FIG. 2, in other embodiments the server 130 may include multiple processors.

The storage device 220 stores instructions and/or data that may be executed by processor 210. The instructions and/or data may comprise code for performing any and/or all of the techniques described herein. In one embodiment, the storage device 220 is a non-volatile memory device or similar permanent storage device and media. For example, the storage device 220 is a hard disk drive, a floppy disk drive, a CD-ROM device, a DVD-ROM device, a DVD-RAM device, a DVD-RW device, a flash memory device or some other mass storage device known in the art. The storage device 220 is used to store instructions and/or data for implementing a multi-product clock auction. In one embodiment, the storage device 220 includes an auction manager 250, an activity rule module 260 and an adjustment module 270. In one embodiment, the storage device 220 may comprise a dynamic random access memory (DRAM) device, a static random access memory (SRAM) device, flash memory or some other memory device known in the art. In another embodiment, the storage device 220 comprises a combination of volatile memory and non-volatile memory. The storage device 220 is coupled to the bus 240 for communication with other components of the server 130.

The auction manager module 250 comprises instructions stored in the storage device 220 that, when executed by the processor 210, determine product prices for a round in the multi-product clock auction and determine results for a completed round in the multi-product clock auction. Additionally, the auction manager module 250 includes a database storing bids from one or more bidder devices 110 received via the communication unit 230. In one embodiment, the auction manager 250 communicates the determined product pricing and/or round results to the communication module 230 via the bus 240 for communication to one or more bidder devices 110 and/or the auctioneer 120. The auction manager 250 may also communicate additional information about bid quantities or bidder identities to the communication module 230 for communication the auctioneer 120 and/or to one or more bidder devices 110. The auction manager 250 communicates with the adjustment module 270, further described below, to determine product produces for a round in the multi-product clock auction. In one embodiment, the auction manager 250 communicates with the activity rule module 260, further described below, to determine the eligibility of a bidder for a round of the multi-product clock auction and communicates bidder eligibility to the communication module 230. The auction manager module 250 may also include an auction type identifier specifying whether the auctioneer 120 is purchasing products or selling products.

The activity rule module 260 comprises instructions stored in the storage device 220 that, when executed by the processor 210, determine the eligibility of a bidder for a round in the multi-product clock auction. In one embodiment, the activity rule module 260 receives a bidder's activity from a completed round in the multi-product clock auction and sets the bidder's eligibility for the subsequent round as the bidder's activity from the completed round. The activity rule module 260 may include bids retained from earlier rounds when determining the bidder's eligibility when bids are retained to avoid under-subscription of a product. In other embodiments, the activity rule module 260 may use one or more different and/or additional rules to determine a bidder's eligibility for an upcoming round in the multi-product clock auction.

The adjustment module 270 comprises instructions stored in the storage device 220 that, when executed by the processor 210, determine product prices and rollbacks for product prices and/or quantities at different rounds of the multi-product clock auctions. For a procurement multi-product clock auction, execution by the processor 210 of stored instructions comprising the adjustment module 270 determines product prices and product price or quantity rollbacks for a round to minimize expected costs of product procurement. For a sale auction, execution of instructions comprising the adjustment module 270 by the processor 210 determines product prices and rollbacks for a round to maximize revenue. Additionally, the adjustment module 270 allows substitution among different products when a substitution can reduce costs, for a procurement auction, or can increase revenues, for a sale auction, while meeting the auctioneer's 120 needs. In one embodiment, the adjustment module 270 optimizes the adjustment of product prices after rounds of the auction, as further described below in conjunction with FIGS. 3-8.

The communication unit 230 is coupled to the bus 240 and transmits data from the server 130 to the network 140 and receives data from the network 140. In one embodiment, the communication unit 230 includes a port for direct physical connection to the network 104. For example, the communication unit 230 includes a USB, SD, CAT-5 or similar port for wired communication with the network 140. In another embodiment, the communication unit 230 includes a wireless transceiver for exchanging data with the network 140 using one or more wireless communication methods, such as IEEE 802.11, IEEE 802.16, BLUETOOTH® or another suitable wireless communication method. In yet another embodiment, the communication unit 230 includes a cellular communications transceiver for sending and receiving data over a cellular communications network such as via short messaging service (SMS), multimedia messaging service (MMS), hypertext transfer protocol (HTTP), direct data connection, WAP, email, etc. In still another embodiment, the communication unit 230 includes a wired port and a wireless transceiver. The communication unit 230 also provides other conventional connections to the network 104 for distribution of files (media objects) using standard network protocols such as TCP/IP, HTTP, HTTPS and SMTP as will be understood to those skilled in the art.

Multi-Product Clock Auction Method

Figure 3:
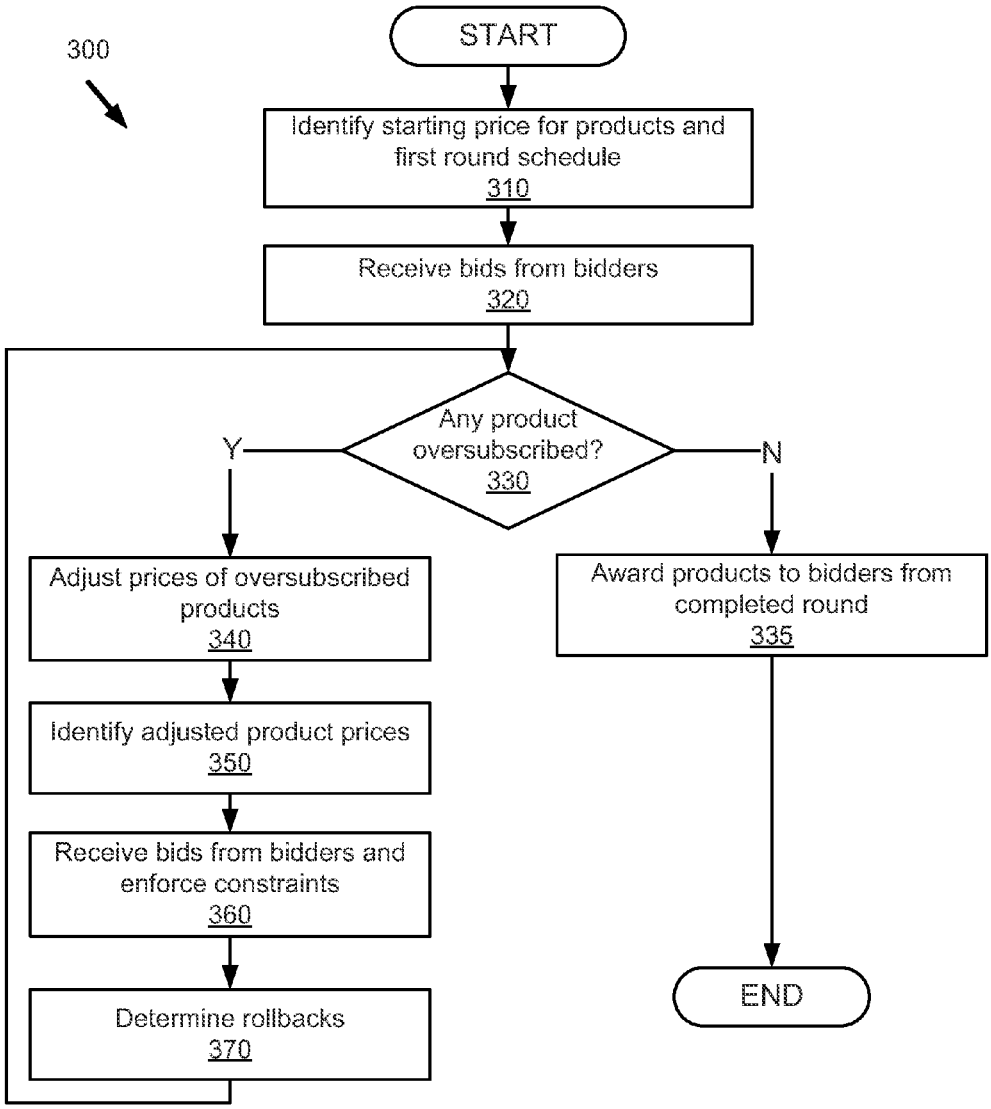
FIG. 3 is a flow chart of one embodiment of a method for implementing a multi-product clock auction in accordance with the present invention.

FIG. 3 shows one embodiment of a method 300 for implementing a multi-product clock auction in accordance with the present invention. Initially, the auction manager module 250 included on the server 130 identifies 310 a first price, such as a starting price, for products being auctioned and a schedule for the first round of the auction. Additionally, the auction manager module 250 determines the total quantities of different products offered by suppliers during the first round. In an embodiment, the auction manager module 250 also receives a target quantity for products from the auctioneer 120, and may also receive one or more threshold values and price adjustments from the auctioneer 120 to modify product prices. The auction manager module 250 then notifies the bidders of the first round schedule and the first product prices. For example, data describing the first round schedule and the first product prices is communicated from the auction manager module 250 to the communication unit 230 of the server 130 and from the communication unit 230 to one or more bidder devices 110A, 110B, 110N via the network 140. During the first round of the multi-product clock auction, the server 130 receives 320 first bids from one or more bidder devices 110A, 110B, 110N via the network 140 and communicates the received bids to the auction manager module 250, which stores the received bids in a database, via the bus 240. The first bids identify quantities of one or more products associated with one or more bidders.

At the conclusion of the first round, the auction manager module 250 determines 330 whether a product in the auction is oversubscribed. In a multi-product clock auction where an auctioneer 120 is buying one or more products from one or more bidders, a product is oversubscribed when the supply of the product exceeds the demand for the product. In a multi-product clock auction where the auctioneer 120 is selling one or more products to one or more bidders, a product is oversubscribed when the demand for the product exceeds the supply of the product. In one embodiment, to determine 330 whether a product is oversubscribed, the auction manager module 250 determines whether the difference between the effective supply of products from the first round bids and the target product quantity specified by the auctioneer 120 is less than or equal to zero and determines whether a quantity of a product from a location exceeds a delivery constraint. To determine the effective supply, the auction manager module 250 determines, for different products, the minimum of the quantity of a product from the first bids and a delivery constraint associated with the product and sums the minimums determined for different products. If the auction manager module 250 determines 330 that no product is oversubscribed at the close of the first round, the products are awarded to the bidders making offers in the first round for the first price posted in the first round.

Figure 4:
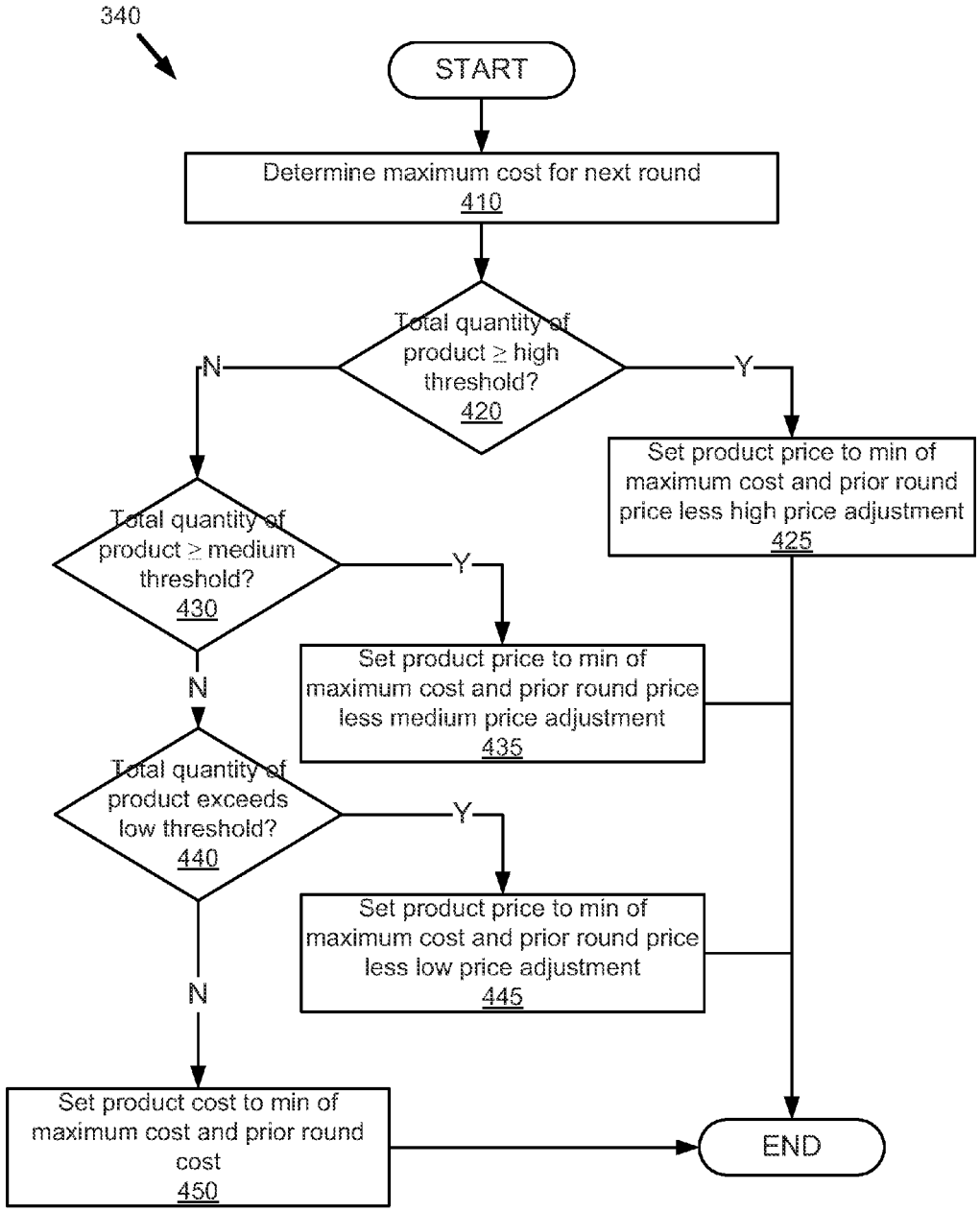
FIG. 4 is a flow chart of one embodiment of a method for adjusting prices of oversubscribed products in a multi-product clock auction where an auctioneer purchases one or more products in accordance with the present invention.
Figure 5:
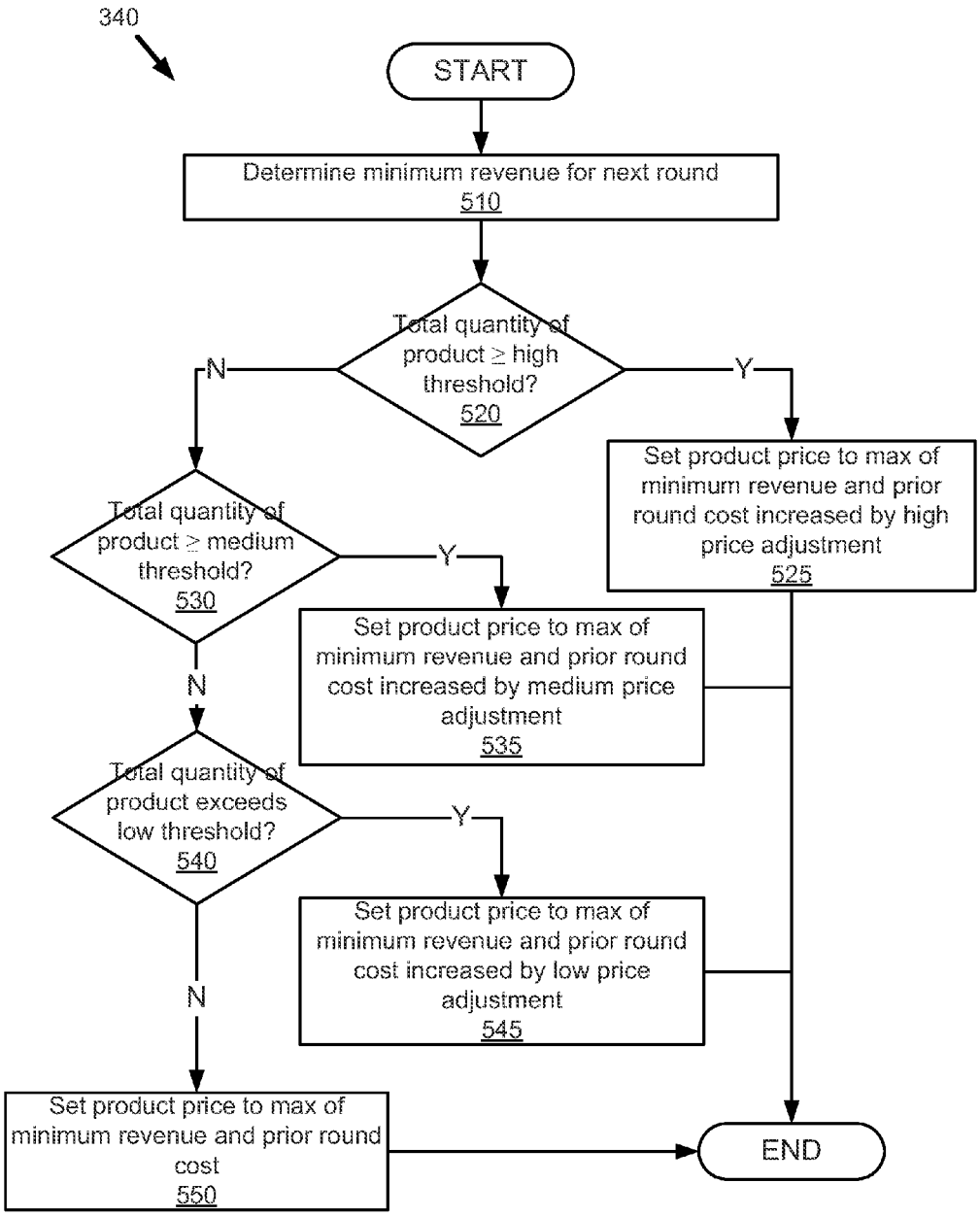
FIG. 5 is a flow chart of one embodiment of a method for adjusting prices of oversubscribed products in a multi-product clock auction where an auctioneer sells one or more products in accordance with the present invention.

However, if the auction manager module 250 determines 330 that a product in the auction is oversubscribed, the auction manager module 250 adjusts 340 the first price of the oversubscribed products to an adjusted price. When the auctioneer 120 is buying products, the auction manager module 250 adjusts 340 the price the oversubscribed product to minimize the expected costs of procurement, while when the auctioneer 120 is selling products, the auction manager module 250 adjusts 340 the price of the oversubscribed products to maximize revenues. In one embodiment, the price adjustment 340 allows the auctioneer 120 to substitute between different products to reduce costs or increase revenues. FIGS. 4 and 5, further described below, provide additional details of adjusting 340 the prices of an oversubscribed product in a procurement multi-product clock auction and in a sale multi-product clock auction, respectively.

The auction manager module 250 then identifies 350 the adjusted prices to the bidders for use in a second round of the multi-product clock auction. For example, the auction manager module 250 communicates the adjusted prices to the bidder devices 110 via the communication unit 230 and the network 140. During the second round of the multi-product clock auction, the auction manager module 250 receives 360 bids from bidders using the adjusted prices. In one embodiment, the auction manager module 250 enforces bidder eligibility constraints and minimum product quantity constraints when receiving 360 bids. For example, if the adjusted price equals the first price, or the price from a prior round, the auction manager module 250 constrains the quantity of a product offered by a bidder in the second round to equal or exceed the quantity of the product offered by the bidder in the first round. As another example, the auction manager module 250 limits a bidder's total quantity offer in the second round to the total quantity the bidder offered in the first round.

After receiving 360 bids for the current round from bidder devices 110, the auction manager module 250 communicates with the adjustment module, which determines 370 whether to roll back prices of a product being auctioned. In one embodiment, the auction manager module 250 disallows price adjustments resulting in a product undersubscription that cannot be remedied by other methods further described below. For example, for a price adjustment that can cause a product to transition from an oversubscribed state or a subscribed state to an undersubscribed state, the adjustment module 270 identifies bidders that have reduced offers of the product and also reduced overall offers from the first round to the second round, affecting the bidder's eligibility in a subsequent round. The adjustment module 270 then rolls back offers from the identified bidders to offers from an earlier round while retaining reduced offers to prevent a product from becoming undersubscribed.

Additionally, to determine 370 whether to roll back prices of a product, the adjustment module 270 determines whether reductions from the first round to the second round in the amount offered by a bidder for an undersubscribed first product can be offset by disallowing an increase in the quantity offered by the bidder in the second round of a second product without leaving the second product undersubscribed. If disallowing the increase in the quantity of the second product offered in the second round does not leave the second product undersubscribed and offsets undersubscription of the first product, in a procurement auction the auction manager module 250 minimizes the sum of the values of the amounts offered for the first product and for the second product using the product prices from the round when the offers for the first product and for the second product were made. If disallowing the increase in the quantity offered of the second product does not leave the second product undersubscribed and offsets undersubscription of the first product, in a sale auction the auction manager module 250 maximizes the sum of the values of the offered amounts based on the product prices from the round when the offers for the first product and for the second product were made. In one embodiment, the adjustment module 270 imposes one or more conditions when minimizing or maximizing the sum of the values of the offered amounts. For example, the adjustment module 270 may prevent a bidder's offer from exceeding the bidder's eligibility for a round, may retain an offer from an earlier round by a bidder at the price at which the bidder submitted the earlier offer and may prevent a previously oversubscribed product from becoming undersubscribed.

After receiving the rolled back prices, if any, from the adjustment module 270, the auction manager module 250 again determines 330 whether a product in the auction is oversubscribed. If the auction manager module 250 determines 330 that no product is oversubscribed at the close of the second round, the products in the multi-product clock auction are awarded to the bidders making offers in the second round. If prices are rolled back, or otherwise adjusted, by the adjustment module 270, the rolled back, or otherwise adjusted, prices are used by the auction manager module 250 to determine 330 whether a product in the auction is oversubscribed. If the auction manager module 250 determines 330 that one or more products in the auction are oversubscribed, the adjustment module 270 adjusts 340 the price of the oversubscribed products and the auction manager module 250 identifies 350 the adjusted prices to the bidders, receives 360 additional bids in a new round of the multi-product clock auction and determines 370 rollbacks from the adjusted prices, as described above. However, if no product is oversubscribed, products are awarded to bidders making offers in the second round for the prices offered in the second round or the adjusted prices, if the second round prices are adjusted. In one embodiment, awarding products after a round when no product is oversubscribed allows the multi-product clock auction to be simultaneously completed for multiple products.

FIG. 4 is a flow chart of an embodiment of a method for adjusting 340 product prices in a multi-product clock auction where an auctioneer 120 is purchasing one or more products from one or more bidders 110 while FIG. 5 is a flow chart of one embodiment of a method for adjusting 340 product prices in a multi-product clock auction where the auctioneer 120 is selling one or more products to one or more bidders. In one embodiment, a processor 210 included in the server 130 executes instructions stored in the adjustment module 270 of the storage device 220 to execute the steps described below in conjunction with FIGS. 4 and 5.

Referring to FIG. 4, in a multi-product clock auction where the auctioneer 120 is purchasing one or more products, the adjustment module 270 initially determines 410 the maximum cost for the upcoming round. In one embodiment, the adjustment module 270 initializes the maximum cost of the most recently completed round to the maximum price of a product from the most recently completed round. In one embodiment, the adjustment module 270 accounts for the delivery cost of a product when initializing the maximum cost by initializing the maximum cost to the maximum of sum of a product price and product delivery cost from the most recently completed round, such as the first round. The adjustment module 270 then determines the maximum cost of the subsequent round, such as the second round, by modifying the maximum cost of the most recently completed round based on the difference between the effective supply of products after completion of the first round and the target product quantity specified by the auctioneer 120. To calculate the effective supply of products, the adjustment module 270 determines the minimum of the quantity of a product offered in the first round and the delivery constraint of a product for multiple products and sums the minimums.

In one embodiment, during identification 310 of the starting price and first round schedule, the auction manager module 250 receives and stores excess supply thresholds from the auctioneer 120. For example, the auction manager module 250 stores a low threshold value, a medium threshold value and a high threshold value. The auction manager module 250 also associates one or more price adjustments with the threshold values. For example, a low price adjustment is associated with the low threshold value, a medium price adjustment is associated with the medium threshold value and a high price adjustment is associated with the high threshold value.

If the difference between the effective supply of products after completion of the first round and the target product quantity specified by the auctioneer 120 equals or exceeds the high threshold, the adjustment module 270 defines 410 the maximum cost for the second round as the maximum cost for the first round less the high price adjustment. If the difference between the effective supply of products after completion of the first round and the target product quantity specified by the auctioneer 120 equals or exceeds the medium threshold, the adjustment module 270 defines 410 the maximum cost for the second round as the maximum cost for the first round less the medium price adjustment. If the difference between the effective supply of products after completion of the first round and the target product quantity specified by the auctioneer 120 exceeds the low threshold, the adjustment module 270 defines 410 the maximum cost for the second round as the maximum cost for the first round less the low price adjustment. However, the difference between the effective supply of products after completion of the first round and the target product quantity specified by the auctioneer 120 is less than or equal to the low threshold, the adjustment module 270 determines 410 that the maximum cost for the second round is the maximum cost for the first round.

After determining 410 the maximum cost for the second round, the adjustment module 270 determines a product price for the second round. The adjustment module 270 determines 420 whether the total quantity of the product from the first round less a delivery constraint exceeds or equals or exceeds the high threshold, and if the total quantity of the product from the first round less the delivery constraint equals or exceeds the high threshold, the adjustment module 270 sets 425 the product price for the second round to the minimum of the maximum cost for the second round less a delivery cost and the product price from the first round less the high price adjustment.

If the total quantity of the product form the first round less the delivery constraint is less than the high threshold, the adjustment module 270 determines 430 whether the total quantity of the product from the first round less the delivery constraint equals or exceeds the medium threshold. Responsive to the quantity of the product from the first round less the delivery constraint equaling or exceeding the medium threshold, the adjustment module 270 sets 435 the product price for the second round to the minimum of the maximum cost for the second round less a delivery cost and the product price from the first round less the medium price adjustment. If the total quantity of the product from the first round less the delivery constraint is less than the medium threshold, the adjustment module 270 determines 440 whether the total quantity of the product from the first round less the delivery constraint exceeds the low threshold and sets 445 the product price for the second round as the minimum of the maximum cost for the second round less a delivery cost and the product price from the first round less the low price adjustment if the total quantity of the product from the first round less the delivery constraint exceeds the low threshold. In response to the quantity of the product from the first round less the delivery constraint being less than or equal to the low threshold, the adjustment module 270 sets 450 the product cost for the second round as the minimum of the maximum cost for the second round less a delivery cost and the product price from the first round. In one embodiment, the product prices for the first round account for the product delivery cost, so subtraction of the product delivery cost from the product price from the first round is not performed.

Similarly, FIG. 5 illustrates a flow chart of a method for adjusting 340 the price of oversubscribed products in a multi-product clock auction where the auctioneer 120 is selling one or more products. When the auctioneer 120 is selling a product, the adjustment module 270 initially determines 410 the minimum revenue for the upcoming round, such as a second round. In one embodiment, the adjustment module 270 initializes the minimum revenue of the first round to the minimum product price from the first round. In another embodiment, the adjustment module 270 accounts for the delivery cost of a product when initializing the minimum revenue, so that the minimum revenue is initialized to the minimum product price from the first round increased by product delivery cost. The adjustment module 270 then determines the minimum revenue of the second round by modifying the minimum revenue of the first round based on the difference between the effective supply of products after completion of the first round and the target product quantity specified by the auctioneer 120.

In one embodiment, during identification 310 of the starting price and first round schedule, the auction manager module 250 receives and stores a low threshold value, a medium threshold value and a high threshold value and associates one or more price adjustments with the threshold values. For example, a low price adjustment is associated with the low threshold value, a medium price adjustment is associated with the medium threshold value and a high price adjustment is associated with the high threshold value.

If the difference between the effective supply of products after completion of the first round and the target product quantity specified by the auctioneer 120 equals or exceeds the high threshold, the adjustment module 270 defines 510 the minimum revenue for the second round as the minimum revenue for the first round decreased by the high price adjustment. If the difference between the effective supply of products after completion of the first round and the target product quantity specified by the auctioneer 120 equals or exceeds the medium threshold, the adjustment module 270 defines 510 the minimum revenue for the second round as the minimum revenue for the first round decreased by the medium price adjustment. If the difference between the effective supply of products after completion of the first round and the target product quantity specified by the auctioneer 120 exceeds the low threshold, the adjustment module 270 defines 510 the minimum revenue for the second round as the minimum revenue for the first round decreased by the low price adjustment. However, if the difference between the effective supply of products after completion of the first round and the target product quantity specified by the auctioneer 120 is less than or equal to the low threshold, the adjustment module 270 determines 510 that the minimum revenue for the second round is the minimum revenue for the first round.

After determining 510 the minimum revenue for the second round, the adjustment module 270 determines a product price for the second round using the determined minimum revenue for the second round. The adjustment module 270 determines 520 whether the total quantity of the product from the first round less a delivery constraint exceeds or equals or exceeds the high threshold, and if the total quantity of the product from the first round less the delivery constraint equals or exceeds the high threshold, the adjustment module 270 sets 525 the product price for the second round to the maximum of the minimum revenue for the second round decreased by product delivery cost and the product price from the first round increased by the high price adjustment.

If the total quantity of the product form the first round less the delivery constraint is less than the high threshold, the adjustment module 270 determines 530 whether the total quantity of the product from the first round less the delivery constraint equals or exceeds the medium threshold. Responsive to the quantity of the product from the first round less the delivery constraint equaling or exceeding the medium threshold, the adjustment module 270 sets 535 the product price for the second round to the maximum of the minimum revenue for the second round decreased by product delivery cost and the product price from the first round increased by the medium price adjustment. If the total quantity of the product from the first round less the delivery constraint is less than the medium threshold, the adjustment module 270 determines 540 whether the total quantity of the product from the first round less the delivery constraint exceeds the low threshold and sets 545 the product price for the second round as the maximum of the minimum revenue for the second round decreased by product delivery cost and the product price from the first round increased by the low price adjustment if the total quantity of the product from the first round less the delivery constraint exceeds the low threshold. In response to the quantity of the product from the first round less the delivery constraint being less than or equal to the low threshold, the adjustment module 270 sets 550 the product price for the second round as the maximum of the minimum revenue for the second round decreased by product delivery cost and the product price from the first round. In one embodiment, the product prices for the first round account for the product delivery cost, so subtraction of the product delivery cost from the product price from the first round is not performed.

Adjustment of Product Prices for a Subsequent Multi-Product Clock Auction Round

FIG. 6 is a flow chart of one embodiment of a method for determining 370 price rollbacks, reduction rollbacks and/or product switch rollbacks in accordance with the present invention. Initially, adjustment module 270 calculates 610 the total products offered by the suppliers during the current round. For example, the adjustment module 270 sums the quantities of a product offered during a round to calculate 610 the total products offered in the round. The adjustment module 270 also calculates 620 the total effective supply of products offered in the subsequent round. To calculate 620 the effective supply of products offered in the round, for multiple products, the adjustment module 270 determines the minimum of the total quantity of a product offered in the round and the delivery constraint for the product and sums the resulting minimum values.

In a multi-product clock auction where the auctioneer 120 is buying products from bidders, the adjustment module 270 then calculates 630 the product delivery costs for different products by calculating the sum of the product prices in the current round and the delivery costs of the products. In a multi-product clock auction where the auctioneer 120 is selling products to bidders, the adjustment module 270 calculates 630 the net revenue for different products by subtracting the delivery cost from the product price in the current round. Using the calculated product delivery costs, for a multi-product clock auction where the auctioneer 120 is purchasing products, or the calculated net revenue for different products, for a multi-product clock auction where the auctioneer 120 is selling products, the adjustment module 270 determines 640 the cost of filling the demand for products. For example, when the auctioneer 120 is purchasing products the adjustment module 270 determines 640 the cost of filling product demand by selecting products having the lowest product delivery costs to fill demand. As another example, when the auctioneer 120 is selling products, the adjustment module 270 determines 640 the cost of filling product demand by selecting products having the highest net revenue. After selecting products to fill demand, the adjustment module 270 determines 640 the current cost, or current revenue, by determining 640 the minimum of the unfilled demand for a product and the total quantity offered for the product and multiplying the minimum by the delivery cost of the product or multiplying the minimum by the net revenue of the product when the auctioneer 120 is buying or selling products, respectively.

When the auctioneer 120 is purchasing products, the adjustment module 270 determines 650 whether the current cost exceeds the cost for the prior round, while when the auctioneer 120 is selling products, the adjustment module 270 determines 650 whether the current revenue is less than the revenue for the prior round. If the auctioneer 120 is purchasing products and the current cost exceeds the cost for the prior round, the adjustment module 270 determines 655 whether there is a reason to rollback the price for a product to a price from a prior round. Similarly, if the auctioneer 120 is selling products and the current revenue is less than the revenue for the prior round, the adjustment module 270 determines 655 whether there is a reason to rollback the price for a product to a price from a prior round.

For example, if the auctioneer is purchasing products, the adjustment module 270 rolls back 665 the price of a product to a price from the prior round if the price of the product from the prior round is less than the sum of the maximum cost for the current round and the delivery cost and the quantity of the product offered in the current round is less than the minimum of the delivery constraint for the product and the quantity of the product offered in the prior round. As another example, if the auctioneer 120 is selling products, the adjustment module 270 rolls back 665 the price of a product to a price from the prior round if the price of the product from the prior round exceeds the sum of the minimum revenue for the current round and the delivery cost and the quantity of the product offered in the current round is less than the minimum of the delivery constraint for the product and the quantity of the product offered in the prior round. If the adjustment module 270 determines 655 there is not a reason to rollback the price of a product to a price form a prior round, the adjustment module 270 selects 657 a second product and determines 655 whether there is a reason to rollback the price of the second product to a price from the prior round, as described above.

After rolling back 665 a product price, the adjustment module 270 determines 675 the excess of the product whose price was rolled back. In one embodiment, the excess is determined 675 by subtracting the quantity offered in the current round of the product whose price was rolled back from the minimum of the delivery constraint of the product whose price was rolled back and the quantity offered in the prior round of the product whose price was rolled back. The excess indicates the amount of extra supply of, or demand for, a product that is sought to be recovered.

The adjustment module 270 then identifies 685 bidders reducing the quantity offered of a product (also referred to herein as "reducing bidders"). In one embodiment, reducing bidders are identified 685 as bidders offering fewer products in the current round than in the prior round. Upon identifying 685 a reducing bidder, the adjustment module 270 sets the quantity offered in the current round of the product whose price was rolled back by the reducing bidder to the minimum of the quantity offered in the prior round of the product whose price was rolled back offered by the reducing bidder and the sum of the quantity offered in the current round of the product whose price was rolled back by the reducing bidder and the excess of the product whose price was rolled back. After modifying the quantity of the product whose price was rolled back offered by the reducing bidder in the current round, the adjustment module 270 resets the excess of the product whose price was rolled back by subtracting the quantity offered in the current round of the product whose price was rolled back offered in the current round from the minimum of the delivery constraint of the product whose price was rolled back and the quantity offered in the prior round of the product whose price was rolled back. If resetting causes the excess of the product whose price was rolled back to zero, a second reducing bidder is identified 685 and the quantity offered in the current round of the product whose price was rolled back by the second reducing bidder is rolled back as described above. If resetting causes the excess of the product whose price was rolled back to not exceed zero, the adjustment module 270 identifies a second product whose price was rolled back and identifies 685 reducing bidders for the second product whose price was rolled back, as described above.

After identifying 685 reducing bidders, and rolling back the product quantities offered by reducing bidders if necessary, the adjustment module 270 identifies 695 bidders offering different quantities of a first product and a second product in the prior round and in the current round (also referred to herein as "switching bidders"). The adjustment module 270 identifies a switching bidder when a bidder offers a greater quantity of first product in a prior round the quantity offered in the current round incremented by a constant, such as one, and the bidder offers a quantity of the second product in the prior round that is less than or equal to the quantity offered by the bidder of the second product in the current round incremented by a constant, such as one. If a switching bidder is identified, the adjustment module 270 rolls back one unit of the product switch, as described below in conjunction with FIG. 7.

If the auctioneer 120 is purchasing products and the current cost does not exceed the cost for the prior round, the adjustment module 270 determines 660 a product shortfall from the effective supply of products for the current round and the target quantity of products desired by the auctioneer 120. In one embodiment, the adjustment module 270 calculates the effective supply of products in the current round by determining the minimum of the total quantity of a product offered in the current round and the delivery constraint for the product and summing the minimum values for multiple products. The adjustment module 270 determines 660 the shortfall by subtracting the effective supply of products in the current round from the minimum of the target quantity of products specified by the auctioneer 120 and the effective supply of products in the prior round.

Responsive to determining 670 the shortfall is less than or equal to zero, the adjustment module 270 completes the rollback determination. However, responsive to determining 670 the shortfall is greater than zero, the adjustment module 270 determines 680 the excess of one or more products to identify the quantity of product that may be recovered via rollback. If the total quantity offered of the product in the current round is less than the minimum of the total quantity offered of the product in the prior round and the product delivery constraint, the adjustment module 270 rolls back the price of the product to the price from the prior round. The adjustment module 270 then determines the minimum of the delivery constraint for the product and the total quantity offered of the product in the prior round. The adjustment module 270 then calculates the difference between the quantity of the product offered in the current round from the minimum of the delivery constraint for the product and the total quantity. The excess of the product is determined 680 to be the minimum of the shortfall and the calculated difference.

One or more bidders reducing the quantity of product offered from the prior round to the current round ("reducing bidders") are then identified 690. In one embodiment, the adjustment module 270 subtracts the quantity of a product offered during the current round from the quantity of the product offered by the bidder during the prior round and sums the differences for different products offered by the bidder to calculate a product decrease for the bidder. If the resulting sum is greater than zero, the bidder is identified 690 as a reducing bidder, and the adjustment module 270 calculates an adjustment for the reducing bidder. In one embodiment, the adjustment is calculated by subtracting the quantity of a product offered by the bidder in the current round from the quantity of the product offered by the bidder in the prior round to determine a product quantity difference. The adjustment module 270 then determines the minimum of the product quantity difference, the excess of the product and the decrease in products offered by the bidder from prior round to current round. The quantity of the product offered by the reducing bidder in the current round is increased by the adjustment and the total quantity of the product offered in the current round is increased by the adjustment. The adjustment module 270 then generates a modified shortfall by subtracting the adjustment from the shortfall and generates a modified excess of a product whose price has been rolled back by determining the minimum of the delivery constraint for the product and the total quantity of the product offered in the prior round. The adjustment module 270 then calculates the modified product excess as the minimum of the difference between the modified total quantity of the product offered in the current round from the minimum of the delivery constraint for the product and the total quantity. If the modified product excess is less than or equal to zero, a different product whose price has been rolled back is identified and the above-described steps are repeated.

After identifying reducing bidders and rolling back their reductions, the adjustment module identifies 697 bidders offering different quantities of a first product and a second product between the prior round and the current round (also referred to herein as "switching bidders"). In one embodiment, the adjustment module 270 identifies 697 a switching bidder performing a damaging product switch when: (1) the quantity of the first product offered by the bidder in the prior round is greater than or equal to the quantity of the first product offered by the bidder in the current round incremented by a constant, such as one, (2) the total quantity of the first product offered in the current round is less than the delivery constraint of the first product, (3) the quantity of the second product offered by the bidder in the prior round is less than or equal to the quantity of the second product offered by the bidder in the current round incremented by a constant, such as one and (4) the total quantity of the second product offered in the current round is greater than or equal to the delivery constraint of the first product incremented by a constant, such as one. If a switching bidder performing a damaging product switch is identified, the adjustment module 270 rolls back one unit of the damaging product switch, as described below in conjunction with FIG. 8.

Figure 7:
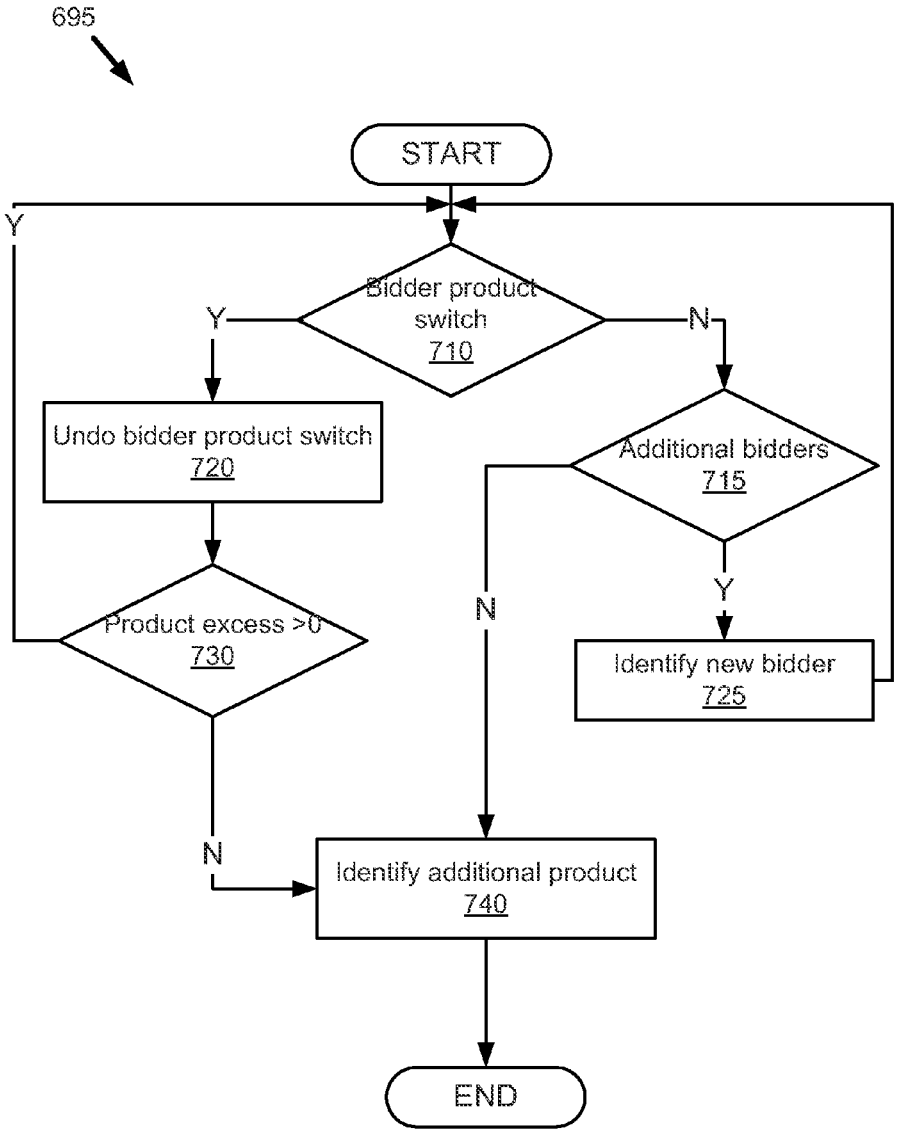
FIG. 7 is a flow chart of one embodiment of a method for rolling back switching bidders in accordance with the present invention.

FIG. 7 is a flow chart of one embodiment of a method for rolling back switching bidders in accordance with the present invention. Initially, the adjustment module 270 determines 710 whether a bidder switches between a first product and a second product from the prior round to the current round. In one embodiment, the adjustment module 270 determines that a bidder switches between the first product and the second product when the quantity of the first product offered by the bidder in the prior round is greater than or equal to the quantity of the first product offered by the bidder in the current round incremented by a constant, such as one, and the quantity of the second product offered by the bidder in the prior round is less than or equal to the quantity of the second product offered by the bidder in the current round incremented by the constant.

Responsive to determining a bidder has switched between the first product and the second product, the adjustment module 270 undoes 720 one unit of the bidder's product switch. For example, the adjustment module 270 increments the quantity of the first product offered by the bidder in the current round by a value, such as one, and decrements the quantity of the second product offered by the bidder in the current round by the value. This also causes the adjustment module 270 to decrease the excess of the product by one, increment the total quantity offered of the first product in the current round by one and decrement the total quantity offered of the second product in the current round by the value. After decrementing the excess of the product, the adjustment module 270 determines 730 whether the excess of the product is greater than zero. If the excess of the product is greater than zero, the adjustment module 270 again determines 710 whether the bidder has switched between the first product and the second product, as described above, and undoes 720 an identified bidder product switch as described above. If the excess of the product does not exceed zero, the adjustment module 270 identifies 740 an additional product.

Responsive to determining a bidder has not switched between the first product and the second product, the adjustment module 270 determines 715 whether the multi-product clock auction includes additional bidders and identifies 725 a new bidder if there are additional bidders in the multi-product clock auction. The adjustment module 270 then determines 710 whether the new bidder has switched between the first product and the second product from the prior round to the current round, as described above. If there are not additional bidders in the multi-product clock auction an additional product is identified 740.

Figure 8:
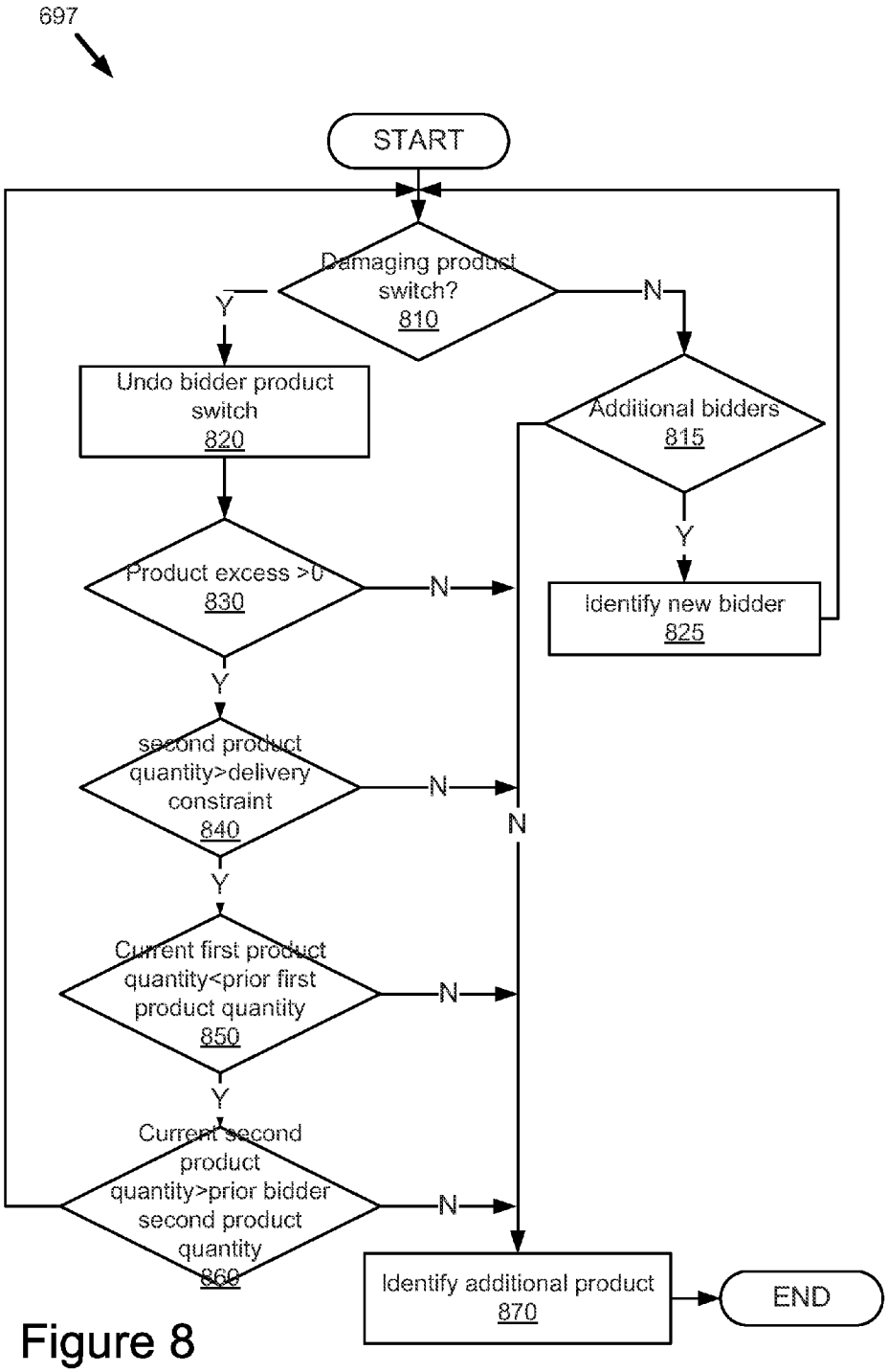
FIG. 8 is a flow chart of one embodiment of a method for rolling back damaging switching bidders in accordance with the present invention.

FIG. 8 is a flow chart of one embodiment of a method for rolling back a damaging product switch performed by a switching bidder in accordance with the present invention. Initially, the adjustment module 270 determines 810 that a bidder has performed a damaging product switch from a first product to a second product from the prior round to the current round when: (1) the quantity of the first product offered by the bidder in the prior round is greater than or equal to the quantity of the first product offered by the bidder in the current round incremented by a constant, such as one, (2) the total quantity of the first product offered in the current round is less than the delivery constraint of the first product, (3) the quantity of the second product offered by the bidder in the prior round is less than or equal to the quantity of the second product offered by the bidder in the current round incremented by a constant, such as one, and (4) the total quantity of the second product offered in the current round is greater than or equal to the delivery constraint of the first product incremented by one. In response to determining 810 a switching bidder performs a damaging product switch, the adjustment module 270 undoes 820 the damaging product switch.

In one embodiment, a damaging product switch is undone 820 by incrementing the quantity of the first product offered by the bidder in the current round by an amount, such as one, and decrementing the quantity of the second product offered by the bidder in the current round by the amount. This also causes the adjustment module 270 to decrease the excess of the product by one, increment the total quantity offered of the first product in the current round by one and decrement the total quantity offered of the second product in the current round by one.

After decrementing the excess of the product, the adjustment module 270 determines 830 whether the excess of the product is greater than zero. If the excess of the product is not greater than zero, the adjustment module 270 identifies 870 an additional product. If the excess of the products is equals or exceeds zero, the adjustment module determines 840 whether the total quantity of the second product offered during the current round is greater than the delivery constraint associated with the second product. Responsive to the total quantity of the second product offered during the current round not exceeding the delivery constraint associated with the second product, the adjustment module 270 identifies 870 an additional product.

If the total quantity of the second product offered during the current round is greater than the delivery constraint, the adjustment module 270 determines whether the quantity of the first product offered by the switching bidder in the current round is less than the quantity offered by the switching bidder of the first product offered in the prior round by the switching bidder. Responsive to the quantity of the first product offered in the current round by the switching bidder equaling or exceeding the quantity of the first product offered in the prior round, the adjustment module 270 identifies 870 an additional product. Otherwise, the adjustment module 270 determines 860 whether the quantity offered in the current round by the switching bidder of the second product exceeds the quantity offered in the prior round by the switching bidder of the second product. Responsive to the quantity of the second product offered by the switching bidder in the current round not exceeding the quantity offered in the prior round by the switching bidder of the second product, the adjustment module 270 identifies 870 an additional product. If the quantity offered in the current round by the switching bidder of the second product exceeds the quantity offered in the prior round by the switching bidder of the second product, the adjustment 270 again determines 810 whether a damaging product switch occurs between the first product and the second product, as described above, and undoes 820 a damaging product switch by a switching bidder product switch as described above.

Responsive to determining a switching bidder does not perform a damaging product switch, the adjustment module 270 determines 815 whether the multi-product clock auction includes additional bidders and identifies 825 a new bidder if there are additional bidders in the multi-product clock auction. The adjustment module 270 then determines 810 whether the new bidder is a switching bidder performing a damaging product switch, as described above. If there are not additional bidders in the multi-product clock auction an additional product is then identified 870.

One implementation of the multi-product clock auction method described above is a procurement auction where the auctioneer 120 is purchasing electrical power from bidders. For example, the auctioneer 120 desires to purchase Q units of power originating at one of several locations, identified using a value, k, ranging from 1 to K. Each location is subject to a capacity or transmission constraint amounting to a delivery constraint on the ability of a location to provide power. Additionally, each location has an associated delivery cost, which is the per-unit cost of transmission of electric power from a location. A bidder device 110 is associated with each bidder, allowing a bidder to make an offer to sell units of power from a location. Further, the auctioneer 120 communicates a low threshold, a high threshold and a medium threshold to identify different levels of excess supply of power to a server 130 and associates low price adjustment, a medium price adjustment and a high price adjustment, respectively, with the thresholds. The auctioneer 120 also specifies an initial maximum cost per unit of power, denoted as M(1). Thus, the auction prices at the first round are $p_k(1)=M(1)-c_k$, where $c_k$ denotes the cost of transmission of a unit of power from location k. At round R of the auction, $p_k(R)$ indicates the price of a unit of power from location k.

Using the method described above in conjunction with FIGS. 3-8 to implement the auction where electric power is purchased allows the server 130 used to conduct the auction to alter the bids received from various bidders during a round of the auction to more efficiently allocate power form the different locations while still fulfilling the auctioneer's 120 quality. The method described in conjunction with FIGS. 2-8 account for transmission constraints from different location by accounting for delivery costs, allowing more efficient adjustment of prices between rounds by rolling back prices or quantities based on round results.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

APPENDIX

What follows is an example of an implementation of this process for determining end of round adjustments in clock auctions in form of an algorithm.

This whole procedure is developed using terminology according to which different (substitute) products are the same physical product available at different locations and subject to transport costs and constraints. We have optimized the price-decrementing algorithm for a generalization of that structure, described below.

In the description of the algorithm provided below, the following terms are used:

Target Quantity, Q: The auctioneer wishes to buy Q units originating at one of several locations. Each location has its own index number k between 1 and K.

Each location k is subject to a capacity or delivery constraint or Limit $L_k$.

Also, each location has an associated cost of delivery of $c_k$ per unit. (Note: If the interface calls for the auctioneer to establish initial prices, then one can impute the costs $c_k$ as follows. For the location k with the highest opening price, set $c_k=0$. For other locations, compute $c_k$ to be the difference between the opening price of this product and the opening price of the highest priced product.).

We assume that the problem is feasible: $L_1+\ldots+L_K\geq Q$. If this inequality fails, then the software should generate an infeasibility message.

There are several bidders making offers to sell. Each has its own index number n between 1 and N.

When the auction is set-up, the auctioneer sets excess supply Thresholds to define Low, Medium and High levels of excess supply. The numerical thresholds are denoted by 0, $T_M$, and $T_H$. Also set up are the corresponding price Decrements, $D_L$, $D_M$, and $D_H$.

Finally, the auctioneer sets up an initial Maximum cost per unit: M(1). The auction prices at round #1 for each location k are then $p_k(1)=M(1)-c_k$ so that the total cost, including delivery costs, of each product is M(1). (Below, we define new maximum costs M(R+1) after each Round R.)

For each round R, the price of product k is denoted by $p_k(R)$.

The quantity offered by bidder n of product k is denoted by $x_{nk}(R)$.

The total quantity offered of product k is denoted by $q_k(R)=x_{1k}(R)+\ldots+x_{nK}(R)$. The effective supply is $ES(R)=\min(q_1(R),L_1)+\ldots+\min(q_K(R),L_K)$. That is the maximum amount available to meet the Auction Manager's needs, given the offers and other limits on what can be delivered.

At the end of each round R≥2, after any rollback if necessary, the auction will always satisfy the condition that $ES(R)\geq\min(Q,ES(R-1))$. Thus, if the auction is initially oversubscribed, it remains so. If not, the amount of undersubscription never gets worse. The auction then proceeds according to the following rules.

1. Post the initial prices and collect quantity offers from the bidders. Total quantities and effective supply are computed for the first round.
   a. Set R=1.
   b. For each product k, the total quantity offered by all suppliers in round 1 is $q_k(1)=x_{1k}(1)+\ldots+x_{Nk}(1)$.
   c. Total effective supply after round 1's bids have been received is $ES(1)=\min(q_1(1),L_1)+\ldots+\min(q_K(1),L_K)$
   d. If $ES(R)-Q\leq 0$ and $q_k(R)\leq L_k$ for every product k, then the auction is ended and the final allocation from round R implemented. Otherwise, set the round to R+1 and continue as below.
2. For round R+1, compute the "maximum cost" M(R+1) by: (minimum revenue)
   a. Reset $M(R)=\max(p_1(R)+c_1,\ldots,p_K(R)+c_K)$. (mr=min $[p_1(R)-c_1,\ldots,p_K(R)-c_K]$
   b. If $ES(R)-Q\geq T_H$, then $M(R+1)=M(R)-D_H$.
   c. Otherwise, if $ES(R)-Q\geq T_M$, then $M(R+1)=M(R)-D_M$.
   d. Otherwise, if $ES(R)-Q>0$, then $M(R+1)=M(R)-D_L$.
   e. Otherwise, if $ES(R)-Q\leq 0$, then M(R+1)=M(R).
3. Using the maximum cost, compute the prices associated with each product as follows. If Auction Type="Buy" then
   a. If $q_k(R)-L_k\geq T_H$, then $p_k(R+1)=\min(M(R+1)-c_k, p_k(R)-D_H)$.
   b. Otherwise, if $q_k(R)-L_k\geq T_M$, then $p_k(R+1)=\min(M(R+1)-c_k, p_k(R)+D_M)$.
   c. Otherwise, if $q_k(R)-L_k>0$, then $p_k(R+1)=\min(M(R+1)-c_k, p_k(R)+D_L)$.
   d. Otherwise, $q_k(R)-L_k\leq 0$ and $p_k(R+1)=\min(M(R+1)-c_k, p_k(R))$.

Else if Auction Type="Sell" then
   a. If $q_k(R)-L_k\geq T_H$, then $p_k(R+1)=\max(M(R+1)-c_k, p_k(R)+D_H)$.
   b. Otherwise, if $q_k(R)-L_k\leq T_M$, then $p_k(R+1)=\max(M(R+1)-c_k,p_k(R)+D_M)$.
   c. Otherwise, if $q_k(R)-L_k>0$, then $p_k(R+1)=\max(M(R+1)-c_k, p_k(R)+D_L)$.
   d. Otherwise, $q_k(R)-L_k\leq 0$ and $p_k(R+1)=\max(M(R+1)-c_k, p_k(R))$.

End If
4. Post the prices from step 3 and collect quantity offers from the bidders. The details of this process are presumably familiar and are only sketched below. I assume that eligibility constraints and minimum quantity constraints, if any, are imposed when the bids are entered.
   a. If $p_k(R+1)=p_k(R)$, then enforce the constraint $x_{nk}(R+1)\geq x_{nk}(R)$.
   b. Each bidder n's total quantity offer is limited by its eligibility, which is a given amount for round #1 and, for round R+1, is equal to the total quantity it bid at round R.
   c. Total quantities, effective supply and total cost are computed for round R+1.
      i. For each product k, the total quantity offered by all suppliers is $q_k(R+1)=x_{1k}(R+1)+\ldots+x_{Nk}(R+1)$.
      ii. Total effective supply is $ES(R+1)=\min(q_1(R+1), L_1)+\ldots+\min(q_K(R+1),L_K)$.
      iii. Find the minimum cost, Cost(R+1) of filling the demand from the offered prices and quantities at round R+1, by taking the cheapest products in terms of $p_k(R+1)+c_k$ until demand is filled or offers are exhausted. {Initialize Cost(R+1)=0 and Unfilled(R+1)=0. Run through products k from lowest to highest according to $p_k(R+1)+c_k$ setting
         1. First calculate delivered cost $p_k(R+1)+c_k$ for each k. (for "Sell Auctions," calculate revenues net of shipping costs $p_k(R+1)-c_k$)
         2. Rank products from lowest delivered costs to highest (in sell auctions, rank from highest to lowest.)
         3. Use the ranking to determine which k's to purchase until demand is realized—use all the cheapest product offers first, then go to the next least costly product, etc. (In Sell Auctions, start with highest revenue offers). There may be k for which no purchases are desired. Unfilled $(R+1)=\max(0,\text{Unfilled}(R+1)-q_k(R+1)$ and Cost $(R+1)=\text{Cost}(R+1)+\min[\text{Unfilled}(R+1),q_k(R+1)][p_k(R+1)+c_k]$}

Generally, the algorithm leads to the lowest effective prices of the products for which the capacity constraint, on how much of each product can be delivered, binds, based on the idea that nothing is gained by having lower prices and more supply offered from those other products. If the prices overshoot, however, that could cause a purchaser to lose access to cheap, useful supply. Step 5 is introduced to correct that problem in case it arises. The step begins with a test that ensures that it is executed only if the problem is serious enough that Auction Manager's total cost rises despite the round-upon-round reduction in the product-specific prices—that is, only if the mistake is a "big" one. It then rolls back prices and quantities of a product k only if there is something potentially to gain by doing so.

5. If Cost(R+1)≤Cost(R), (For a "Buy Auction compare Revenue(R+1)≥Revenue (R)—the reset of this section "5" and the next "6_is independent of buy or sell) goto 6. Otherwise, execute product-specific rollbacks below.
   a. For each product k, check whether there is a reason to rollback that price in order to reduce total costs. That is, check the following conditions:
      If Auction Type="Buy" then
      $p_k(R)<M(R+1)+c_{k\ AND}q_k(R+1)<\min(L_k,q_k(R))$
      Else If Auction Type="Sell" then
      $p_k(R)>M(R+1)+c_{k\ AND}q_k(R+1)<\min(L_k,q_k(R))$
      End if
      If either condition fails, [there is nothing to be gained by rolling back, so] go to [Next k]. Otherwise, proceed.
   b. Roll back the price of product k: $p_{k+1}(R)=p_k(R)$.
   c. Define Excess(k)=min $(L_k, q_k(R))-q_k(R+1)$. [This is the amount of extra supply (or demand) we are trying to recover from location k.]
   d. Identify "reducers" and rollback their relevant reductions.
      i. For each bidder n, determine whether $\Sigma_{\hat{k}}x_{n\hat{k}}(R+1)<\Sigma_{\hat{k}}x_{n\hat{k}}(R)$. If no, the bidder is not a reducer: goto (vi) [Next n].
      ii. Set $x_{nk}(R+1)=\min(x_{nk}(R), x_{nk}(R+1)+\text{Excess}(k))$
      iii. Reset $q_k(R+1)=\Sigma_n x_{nk}(R+1)$
      iv. Reset Excess(k)=min $(L_k, q_k(R))-q_k(R+1)$
      v. If Excess(k)≤0, goto [Next k]
      vi. Next n.
   e. Identify "switchers" and rollback as needed.
      i. For bidders n=1 . . . N.
      ii. Determine whether both $x_{nk}(R+1)+1\le x_{nk}(R)$ and there is some k' such that $x_{nk'}(R+1)+1\ge x_{nk'}(R)$. (This identifies a "product switch.") If not, go to [Next n].
      iii. Undo one unit of the switch, as follows:
         1. Reset $x_{nk}(R+1)=x_{nk}(R+1)+1$
         2. Reset $x_{nk'}(R+1)=x_{nk'}(R+1)-1$.
         3. Reset Excess(k)=Excess(k)−1,
         4. Reset $q_k(R+1)=q_k(R+1)+1$
         5. Reset $q_{k'}(R+1)=q_{k'}(R+1)-1$.
      iv. If Excess(k)≤0, go to [Next k]; otherwise, goto (ii).
      v. Next n
   f. Next k.

Just as the purpose of step 5 was to deal with cost increases, the purpose of step 6 is to deal with the auction becoming undersubscribed. Or, if the auction began in an undersubscribed condition, step 6 is to prevent that undersubscription from getting worse.

6. Set $ES(R+1)=\min(q_1(R+1),L_1)+\ldots+\min(q_K(R+1),L_K)$.
   Set Q1=min(Q,ES(R))
   Set Shortfall=Q1−ES(R+1). [This is the quantity we would like to recover.]
   If Shortfall≤0, go to step 7. Otherwise, execute the following.
   a. For each k, if $q_k(R+1)\ge\min(q_k(R),L_k)$, go to [Next k].
   b. Roll back the price of product k: $p_{k+1}(R)=p_k(R)$.
   c. Define Excess(k)=min (Shortfall,min$(L_k,q_k(R))-q_k(R+1)$). [This is the amount by which we could hope to roll back product k.]
   d. Identify "reducers" and rollback their relevant reductions.
      i. For each bidder n, $\text{Decrease}_n=\Sigma_{\hat{k}}(x_{n\hat{k}}(R)-x_{n\hat{k}}(R+1))$. If $\text{Decrease}_n\le 0$, then bidder n is not a reducer: goto [Next n].
      ii. Adjustment=min $(x_{nk}(R)-x_{nk}(R+1)$, Excess(k),$\text{Decrease}_n)$
      iii. Reset $x_{nk}(R+1)=x_{nk}(R+1)+\text{Adjustment}$
      iv. Reset $q_k(R+1)=q_k(R+1)+\text{Adjustment}$
      v. Reset Shortfall=Shortfall−Adjustment.
      vi. Excess(k)=min (Shortfall, min $(L_k, q_k(R))-q_k(R+1)$)
      vii. If Excess(k)≤0, goto [Next k]
      viii. Next n.
   e. Identify "switchers" and rollback as needed.
      i. For each bidder n=1 . . . N.
      ii. Determine whether these conditions hold: $x_{nk}(R+1)+1\ x_{nk}(R)$, $q_k(R+1)<L_k$ and there is some k' such that $q_{k'}(R+1)\ge L_{k'}+1$ and $x_{nk'}(R+1)+1\ge x_{nk'}(R)$. (This identifies a "damaging product switch.") If not, go to [Next n].
      iii. Undo one unit of the switch:
         1. Reset $x_{nk}(R+1)=x_{nk}(R+1)+1$ and $x_{nk'}(R+1)=x_{nk'}(R+1)-1$.
         2. Reset Excess(k)=Excess(k)−1, $q_k(R+1)=q_k(R+1)+1$, and $q_{k'}(R+1)=q_{k'}(R+1)-1$.
         3. If any of the following apply, goto [Next k].
            a. Excess(k)≤0.
            b. $q_{k'}(R+1)\le L_k$
            c. $x_{nk}(R+1)\ge x_{nk}(R)$
            d. $x_{nk'}(R+1)\le x_{nk'}(R)$
         4. Goto (ii).
         5. Next n
   f. Next k.
7. Go to step 1.

In the event that $p_k(R+1)=p_k(R)$, no bidder is permitted to reduce its quantity offered on item k at round R+1.

These rollbacks alter the bids $x_{nk}(R+1)$ for various bidders n and products k. It is these altered quantities—and not the original bid quantities—that are to be used in all calculations at the next round, just as if these quantities had been entered by the bidder's themselves. In particular, where minimum quantity bids apply to the next round through the operation of rule 4a, those are computed using the altered quantities, and overall eligibility through rule 4b are computed using the altered quantities.

What is claimed is:

1. A system for implementing a multi-product clock auction where an auctioneer is buying one or more products and where prices of one or more products offered in the multi-product clock auction are modified during the multi-product clock auction, the system comprising:

one or more bidder devices, each bidder device associated with a bidder and configured to receive a bid for one or more products;

a server coupled to the one or more bidder devices, the server comprising:

a processor;

a storage device coupled to the processor, the storage device including:

instructions that when executed by the processor cause execution of a method for implementing a multi-product clock auction, the method comprising the steps of:

receiving, in a first round, first bids for one or more products from one or more bidder devices;

determining from the first bids received in the first round whether at least one product is oversubscribed;

responsive to determining that at least one product is oversubscribed, adjusting a first price associated with the one or more products to generate one or more adjusted prices;

receiving, in a second round using the one or more adjusted prices, second bids for the one or more products from the one or more bidder devices;

identifying from the second bids received in the second round whether at least one product is undersubscribed; and responsive to identifying an undersubscribed product from the second bids received in the second round, generating a rolled back price by rolling back the adjusted price associated with the undersubscribed product to the first price associated with the undersubscribed product;

determining from the second bids, the adjusted price and the rolled back price whether at least one product is oversubscribed; and responsive to no product being oversubscribed, awarding products to bidders using the second bids and the adjusted prices.

2. The system of claim 1, wherein rolling back the adjusted price associated with the undersubscribed product comprises the steps of:

calculating a total products offered during the second round;

calculating a product effective supply associated with the second round;

calculating a cost of filling the second bids with one or more products using the adjusted prices and the second quantities;

responsive to the cost of filling the second bids with one or more products using the adjusted prices exceeding a cost of filling the first bids using the first prices, rolling back the adjusted price associated with the undersubscribed product to the first price.

3. The system of claim 2, wherein rolling back the adjusted price associated with the undersubscribed product further comprising the steps of:

determining an excess of the undersubscribed product;

identifying a bidding device from which a second bid is received;

identifying a first total product quantity from first bids received from the bidding device;

identifying a second total product quantity from second bids received from the bidding device;

responsive to the second total product quantity being less than the first total product quantity, modifying a quantity of the undersubscribed product determined from the second bids received from the bidding device; and calculating a modified excess of the undersubscribed product using the modified quantity of the undersubscribed product.

4. The system of claim 3, wherein the determining the excess of the undersubscribed product comprises:

determining a minimum of a delivery constraint associated with the undersubscribed product and a first undersubscribed product quantity from the first bids received from the bidder device and associated with the undersubscribed product; and subtracting the second quantity associated with the undersubscribed product from the determined minimum.

5. The system of claim 3, wherein the storage device further includes instructions that, when executed by the processor, implement the steps of:

identifying a switching bidding device from which a second bid for the undersubscribed product decreases a quantity of the undersubscribed product relative to the first bids and from which a second bid increasing a quantity of an alternate product relative to the first bids are received is received;

increasing the quantity of the undersubscribed product identified by the second bid received from the switching bidding device by an adjustment; and decreasing the quantity of the alternative product identified by the second bid received from the switching bidding device by the adjustment.

6. The system of claim 2, wherein the storage device further includes instructions that, when executed by the processor, implement the steps of:

responsive to the cost of filling the second bids with one or more products using the adjusted prices not exceeding a cost of filling the first bids using the first prices, determining a product shortfall associated with the second round;

responsive to the product shortfall exceeding zero, rolling back an adjusted price associated with a first product if the adjusted price is less than the minimum of a total quantity of the first product offered in the first round and a delivery constraint associated with the first product;

calculating an excess associated with the first product;

identifying a bidding device from which a second bid is received;

responsive to a total of second quantities associated with the bidding device being less than a total of first quantities associated with the bidding device, calculating an adjustment value; and increasing a quantity of the first product identified by the second bid from the bidding device by the adjustment; and increasing a total quantity of the first product associated with the second round by the adjustment.

7. The system of claim 6, wherein the storage device further includes instructions that, when executed by the processor, implement the steps of:

identifying a switching bidding device from which a second bid for the first product decreases a quantity of the first product relative to the first bid for the first product is received, from which a second bid for an alternate product increases a quantity of the alternate product relative to a first bid for the alternate product is received and wherein a total of a total quantity of the first product in the second round is less than a delivery constraint associated with the first product and a total quantity of the alternate product in the second round is greater than or equal to the sum of a delivery constraint associated with the second product and a constant;

increasing a quantity of the first product identified by the second bid for the first product received from the switching device by an adjustment; and decreasing a quantity of the alternate product identified by the second bid for the alternate product received from the switching device by the adjustment.

8. The system of claim 1, wherein adjusting the first price associated with the one or more products to generate one or more adjusted prices comprises:

determining a maximum cost associated with the second round;

responsive to a sum of the second quantities associated with a product equaling or exceeding a high threshold value, setting an adjusted price associated with the product to the minimum of the maximum cost associated with the second round and the first price decreased by a high price adjustment;

responsive to a sum of the second quantities associated with the product being less than the high threshold value but greater than or equal to a medium threshold value, setting the adjusted price associated with the product to the minimum of the maximum cost associated with the second round and the first price decreased by a medium price adjustment;

responsive to the sum of the second quantities associated with the product being less than the medium threshold value but greater than a low threshold value, setting the adjusted price associated with the product to the minimum of the maximum cost associated with the second round and the first price decreased by a low price adjustment; and responsive to the sum of the second quantities associated with the product being less than the low threshold value, setting the adjusted price associated with the product to the minimum of the maximum cost associated with the second round and the first price;

responsive to the sum of the second quantities associated with the product being less than the low threshold value, setting the adjusted price associated with the product to the minimum of the maximum cost associated with the second round and the first price.

9. A system for implementing a multi-product clock auction where an auctioneer is selling one or more products and where prices of one or more products offered in the multi-product clock auction are modified during the multi-product clock auction, the system comprising:

one or more bidder devices, each bidder device associated with a bidder and configured to receive a bid for one or more products;

a server coupled to the one or more bidder devices, the server comprising:

a processor;

a storage device coupled to the processor, the storage device including:

instructions that when executed by the processor cause execution of a method for implementing a multi-product clock auction, the method comprising the steps of:

receiving, in a first round, first bids for one or more products from one or more bidder devices;

determining from the first bids received in the first round whether at least one product is oversubscribed;

responsive to determining that at least one product is oversubscribed, adjusting a first price associated with the one or more products to generate one or more adjusted prices;

receiving, in a second round using the one or more adjusted prices, second bids for the one or more products from the one or more bidder devices;

identifying from the second bids received in the second round whether at least one product is undersubscribed; and responsive to identifying an undersubscribed product from the second bids received in the second round, generating a rolled back price by rolling back the adjusted price associated with the undersubscribed product to the first price associated with the undersubscribed product;

determining from the second bids, the adjusted price and the rolled back price whether at least one product is oversubscribed; and responsive to no product being oversubscribed, awarding products to bidders using the second bids and the adjusted prices.

10. The system of claim 9, wherein rolling back the adjusted price associated with the undersubscribed product comprises the steps of:

calculating a total products offered during the second round;

calculating a product effective supply associated with the second round;

calculating a revenue from filling the second bids with one or more products using the adjusted prices;

responsive to the revenue filling the second bids with one or more products using the adjusted prices being less than a revenue from filling the first bids using the first prices, rolling back the adjusted price associated with the undersubscribed product to the first price.

11. The system of claim 10, wherein the storage device further includes instructions that, when executed by the processor, implement the steps of:

determining an excess of the undersubscribed product;

identifying a bidding device from which a second bid is received;

identifying a first total product quantity from first bids received from the bidding device;

identifying a second total product quantity from second bids received from the bidding device;

responsive to the second total product quantity being less than the first total product quantity, modifying a quantity of the undersubscribed product determined from the second bids received from the bidding device; and calculating a modified excess of the undersubscribed product using the modified quantity of the undersubscribed product.

12. The system of claim 11, wherein determining the excess of the undersubscribed product comprises:

determining a minimum of a delivery constraint associated with the undersubscribed product and a first undersubscribed product quantity from the first bids received from the bidder device and associated with the undersubscribed product; and subtracting the second quantity associated with the undersubscribed product from the determined minimum.

13. The system of claim 11, wherein the storage device further includes instructions that, when executed by the processor, implement the steps of:

identifying a switching bidding device from which a second bid for the undersubscribed product decreasing a quantity of the undersubscribed product relative to the first bids is received and from which a second bid increasing a quantity of an alternate product relative to the first bids are received is received;

increasing the quantity of the undersubscribed product identified by the second bid received from the switching bidding device by an adjustment; and decreasing the quantity of the alternative product identified by the second bid received from the switching bidding device by the adjustment.

14. The system of claim 10, wherein the storage device further includes instructions that, when executed by the processor, implement the steps of:

responsive to the revenue from filling the second bids with one or more products using the adjusted prices equaling or exceeding a revenue from filling the first bids using the first prices, determining a product shortfall associated with the second round;

responsive to the product shortfall exceeding zero, rolling back an adjusted price associated with a first product if the adjusted price is less than the minimum of a total quantity of the first product offered in the first round and a delivery constraint associated with the first product;

calculating an excess associated with the first product;

identifying a bidding device from which a second bid is received;

responsive to a total of second quantities associated with the bidding device being less than a total of first quantities associated with the bidding device, calculating an adjustment value; and increasing a quantity of the first product identified by the second bid from the bidding device by the adjustment; and increasing a total quantity of the first product associated with the second round by the adjustment.

15. The system of claim 14, wherein the storage device further includes instructions that, when executed by the processor, implement the steps of:

identifying a switching bidding device from which a second bid for the first product decreases a quantity of the first product relative to the first bid for the first product is received, from which a second bid for an alternate product increases a quantity of the alternate product relative to a first bid for the alternate product is received and wherein a total of a total quantity of the first product in the second round is less than a delivery constraint associated with the first product and a total quantity of the alternate product in the second round is greater than or equal to the sum of a delivery constraint associated with the second product and a constant;

increasing a quantity of the first product identified by the second bid for the first product received from the switching device by an adjustment; and decreasing a quantity of the alternate product identified by the second bid for the alternate product received from the switching device by the adjustment.

16. The system of claim 9, wherein adjusting the first price associated with the one or more products to generate one or more adjusted prices comprises:

determining a minimum revenue associated with the second round;

responsive to a sum of the second quantities associated with a product equaling or exceeding a high threshold value, setting an adjusted price associated with the product to the maximum of the minimum revenue associated with the second round and the first price increased by a high price adjustment;

responsive to the sum of the second quantities associated with the product being less than the high threshold value but greater than or equal to a medium threshold value, setting the adjusted price associated with the product to the maximum of the minimum revenue associated with the second round and the first price increased by a medium price adjustment;

responsive to the sum of the second quantities associated with the product being less than the medium threshold value but greater than a low threshold value, setting the adjusted price associated with the product to the maximum of the minimum cost associated with the second round and the first price increased by a low price adjustment; and responsive to the sum of the second quantities associated with the product being less than the low threshold value, setting the adjusted price associated with the product to the minimum of the maximum cost associated with the second round and the first price.

17. The system of claim 16, wherein the storage device further includes instructions that, when executed by the processor, implement the step of:

responsive to the sum of the second quantities associated with the product being less than the low threshold value, setting the adjusted price associated with the product to the minimum of the maximum cost associated with the second round and the first price.

* * * * *